US007788851B2

(12) United States Patent
Curtis et al.

(10) Patent No.: US 7,788,851 B2
(45) Date of Patent: Sep. 7, 2010

(54) WINDOW DRIVE MECHANISM

(75) Inventors: Daniel J. Curtis, Warroad, MN (US); Bradley D. Woodward, Warroad, MN (US); Ronald H. Pederson, Baudette, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 1322 days.

(21) Appl. No.: 10/933,817

(22) Filed: Sep. 3, 2004

(65) Prior Publication Data

US 2006/0048450 A1 Mar. 9, 2006

(51) Int. Cl.
*E05C 9/00* (2006.01)

(52) U.S. Cl. ..... 49/395; 49/250; 49/252

(58) Field of Classification Search ..... 49/187, 49/394, 395, 250, 252; 292/6, 36, 40
See application file for complete search history.

(56) References Cited

U.S. PATENT DOCUMENTS

| | | | | |
|---|---|---|---|---|
| 2,261,941 | A | | 11/1941 | Persson |
| 2,263,813 | A | | 11/1941 | Mason |
| 2,270,202 | A | | 1/1942 | Persson |
| 2,311,413 | A | | 2/1943 | Persson |
| 2,374,618 | A | | 4/1945 | Perreton |
| 2,963,754 | A | | 12/1960 | Herman |
| 3,001,251 | A | | 9/1961 | Johnson |
| 3,101,135 | A | * | 8/1963 | Neal et al. ..... 49/248 |
| 3,238,573 | A | | 3/1966 | Pease, Jr. |
| 3,378,958 | A | | 4/1968 | Parks et al. |
| 3,448,543 | A | | 6/1969 | Multer |
| 3,903,949 | A | | 9/1975 | Aris |
| 4,393,754 | A | | 7/1983 | Hough |
| 4,394,044 | A | | 7/1983 | Hough |
| 4,395,939 | A | | 8/1983 | Hough et al. |
| 4,702,518 | A | | 10/1987 | Paerisch et al. |

(Continued)

FOREIGN PATENT DOCUMENTS

EP 0763643 B1 8/1999

(Continued)

OTHER PUBLICATIONS

"D+HE Ventline-Room-Controller", Brochure from D+H Mechatronic AG, Ammershek/Hamburg, Germany, published Mar. 2004, 4 pages.

(Continued)

*Primary Examiner*—Jerry Redman
(74) *Attorney, Agent, or Firm*—Schwegman, Lundberg & Woessner, P.A.

(57) ABSTRACT

A window drive mechanism includes a bracket and a cam slide moveably coupled to the bracket. In one option, the bracket is coupled to a window frame. An elongate arm is rotatably coupled to a sash substantially adjacent to a first end of the arm. In one option, the elongate arm is rotatably coupled to the bracket substantially adjacent to a second end of the arm. In another option, the elongate arm is moveably coupled to the cam slide between the first end and the second end. An actuator arm is coupled to the cam slide and operable to move the cam slide. A method for making a window assembly optionally includes providing a window frame and coupling a window drive mechanism to the window frame.

30 Claims, 10 Drawing Sheets

U.S. PATENT DOCUMENTS

| | | | | |
|---|---|---|---|---|
| 4,794,730 | A | 1/1989 | Fischbach et al. | |
| 4,802,307 | A | 2/1989 | Schmidt | |
| 4,803,808 | A * | 2/1989 | Greisner | 49/394 |
| 4,829,710 | A | 5/1989 | Schmidt | |
| 4,845,891 | A | 7/1989 | Fischbach | |
| 4,866,882 | A | 9/1989 | Cappello | |
| 4,969,291 | A | 11/1990 | Camara | |
| 5,174,065 | A | 12/1992 | Schlicht | |
| 5,375,376 | A | 12/1994 | Scott | |
| 5,408,784 | A | 4/1995 | Wruck et al. | |
| 5,694,996 | A | 12/1997 | Vigenberg et al. | |
| 6,070,637 | A | 6/2000 | Jancan | |
| 6,260,305 | B1 | 7/2001 | Joyce | |
| 6,598,348 | B2 | 7/2003 | Palicki | |
| 6,941,699 | B2 | 9/2005 | Parsons | |
| 6,966,590 | B1 | 11/2005 | Ksiezopolki et al. | |
| 7,182,119 | B2 | 2/2007 | Woodward et al. | |
| 7,325,359 | B2 | 2/2008 | Vetter | |
| 2006/0048905 | A1 | 3/2006 | Woodward et al. | |
| 2007/0137796 | A1 | 6/2007 | Woodward et al. | |

FOREIGN PATENT DOCUMENTS

| | | | |
|---|---|---|---|
| EP | 0811741 | B1 | 12/2001 |
| EP | 0823522 | B1 | 9/2002 |

OTHER PUBLICATIONS

Woodward, B. D., et al., "Screen Assembly for Outwardly Projecting Window", U.S. Appl. No. 10/933,686, filed Sep. 3, 2004, 44 Pages.

"U.S. Appl. No. 11/678,968, Response filed Dec. 10, 2008 to Non Final Office Action mailed Sep. 10, 2008", 15 pgs.

U.S. Appl. No. 10/933,686, Non Final Office Action mailed Jul. 6, 2006, 5 pgs.

U.S. Appl. No. 10/933,686, Notice of Allowance mailed Dec. 15, 2006, 4 pgs.

U.S. Appl. No. 10/933,686, Response filed Oct. 6, 2006 to Non Final Office Action mailed Jul. 6, 2006, 14 pgs.

U.S. Appl. No. 11/678,968 Final Office Action mailed Apr. 2, 2008, FOAR, 11 Pgs.

U.S. Appl. No. 11/678,968 Advisory Action mailed Jul. 14, 2008, 3 pgs.

U.S. Appl. No. 11/678,968, Response filed Jul. 2, 2008 to Final Office Action mailed Apr. 2, 2008, 10 pgs.

U.S. Appl. No. 11/678,968, Response filed Aug. 4, 2008 to Final Office Action mailed Aug. 2, 2008, 13 pgs.

U.S. Appl. No. 11/678,968 Non-Final Office Action Mailed on Sep. 10, 2008, OARN, 6 Pgs.

"U.S. Appl. No. 10/933,686, Examiner Interview Summary mailed Sep. 29, 2006", 3 pgs.

"U.S. Appl. No. 11/678,968, Notice of Allowance mailed Mar. 3, 2010", 6 pgs.

"U.S. Appl. No. 11/678,968, Examiner Interview Summary mailed Jun. 19, 2008", 2 pgs.

"U.S. Appl. No. 11/678,968, Examiner Interview Summary mailed Jul. 28, 2008", 2 pgs.

"U.S. Appl. No. 11/678,968, Final Office Action mailed Apr. 2, 2009", 5 pgs.

"U.S. Appl. No. 11/678,968, Supplemental Notice of Allowability Mailed May 21, 2010", 4 pgs.

* cited by examiner

WINDOW DRIVE MECHANISM

TECHNICAL FIELD

Window opening and closing mechanisms, for example, for an outwardly projecting window.

BACKGROUND

Many of the current window drive mechanisms used with horizontally projecting windows are large assemblies that have multiple complex mechanisms that increase cost and installation time. In some instances, these drive mechanisms extend around the window frame. These drive mechanisms are bulky and require additional space to retain the drive mechanisms within the window frame or between the window frame and the sash.

Window drive mechanisms with beveled gears are one example of a system useable with horizontally projecting windows. One example of such a drive mechanism is shown in U.S. Pat. No. 4,866,882. The beveled gears translate rotation from a crank to rotating shafts disposed around the window frame. The rotating shafts are threaded and engaged to levers having corresponding threaded collars. The levers are actuated by the rotating shafts to move a window sash to open and closed positions. One disadvantage of this type of drive mechanism is the bulky gearing and shafts needed to open and close the window. The shafts extend around the window frame and take up space between the frame and the sash. Alternatively, the window frame is made larger to store the drive mechanism, requiring additional materials and cost.

Drive mechanisms including chain actuators are another example of a system used to open and close horizontally projecting windows. An example of this type of drive mechanism is shown in U.S. Pat. No. 6,070,637. A chain is looped around the frame and engaged to gears spaced along the frame. The gears include threaded sockets that are coupled to screws coupled to the sash. Rotation of one of the gears through a crank drives the chain which rotates the other gears. The rotating gears translate the sash with respect to the window frame because of the threaded relationship between the sockets and the gears. The size of the mechanism and corresponding size of the frame are a disadvantage with this type of drive mechanism. Space is set aside for the drive mechanism instead of the window, thereby limiting the size of the window or requiring a larger frame. Alternatively, the large drive mechanism is visible and decreases the aesthetic appeal of the window assembly. Moreover, numerous rotations of the crank are required to open and close the sash.

In yet another example, drive mechanisms including scissors linkages and a chain drive are used to open and close horizontally projecting windows. Scissors linkages are disposed on at least two sides of the frame and moveably carry the sash. The chain drive operates to open and close the sash against the frame. The chain drive extends between the frame and the sash at a separate location on the window from the scissors linkages. The chain drive takes up additional space for the window, limiting the size of the window. Alternatively a larger frame is required to house the scissors linkages and the chain drive.

What is needed is a drive mechanism that overcomes the shortcomings of previous drive mechanisms. What is further needed is a drive mechanism that is compact, quick and easy to use.

SUMMARY

A window drive mechanism includes, for example, a bracket and a cam slide moveably coupled to the bracket. The cam slide is moveable along a length of the bracket. In one option, the cam slide includes a slot extending, at least in part, along a slope relative to a movement direction of the cam slide. An elongate arm is rotatably coupled to the bracket substantially adjacent to a first end of the arm. In one option, the bracket is coupled to a window frame and the bracket couples the elongate arm to the window frame. The elongate arm is moveably coupled to the cam slide between the first end and a second end of the arm. In one option, the elongate arm includes a follower pin between the first end and the second end of the arm, and the follower pin is disposed in the slot. In another option, the second end of the arm is rotatably coupled to a sash bracket that couples the elongate arm to a window sash. An actuator arm is coupled to the cam slide.

Several options for the window drive mechanism follow. In one option, the elongate arm is moveably coupled to the cam slide at a point offset from a line extending between where the elongate arm is rotatably coupled to the sash and where the elongate arm is rotatably coupled to the bracket. In another option, the actuator arm is rotatably coupled to an actuator bracket. The actuator bracket is optionally coupled to a window frame. In yet another option, the actuator arm is coupled to the cam slide by a tie rod. The actuator arm, optionally, is rotatably coupled to the tie rod. In still another option, a second cam slide is coupled to the tie rod. The bracket includes at least one projection, in a further option. The projection and bracket are sized and shaped to at least partially surround the elongate arm. The cam slide includes, optionally, a notch dimensioned and configured to receive a hook extending from the elongate arm. In another option, the cam slide includes at least one socket in communication with at least the portion of the slot, and the socket extends substantially parallel to the movement direction of the cam slide.

In another embodiment, a method for making a window assembly includes providing a window frame and moveably coupling a cam slide to the window frame. In one option, the cam slide is moveably coupled to the window frame with a bracket coupled to the window frame and slidably coupled to the cam slide. In another option, the cam slide is slidably coupled to guide rails extending from the bracket. An elongate arm is rotatably coupled to the window frame substantially adjacent to a first end of the arm. The first end of the elongate arm, optionally, is rotatably coupled to the window frame with the bracket. The elongate arm is rotatably coupled to a sash substantially adjacent to a second end of the arm. In yet another option, the elongate arm is rotatably coupled to the sash with a sash bracket coupled to the sash and the elongate arm. The cam slide is moveably coupled to the elongate arm between the first end and the second end. In one option, a pin extending from the arm is disposed in a slot in the cam slide. At least a portion of the slot is slanted relative to a movement direction of the cam slide, in another option. Optionally, the slot extends along a slope relative to the movement direction of the cam slide. An actuator arm is coupled to the cam slide. In one option, the cam slide, a portion of the elongate arm and a portion of the actuator arm are concealed with a screening panel. In another option, the screening panel is coupled to the window frame.

The window drive mechanism described herein provides a compact system disposed between the sash and the window frame. In one option, the drive mechanism is coupled to the jambs of the window frame and presents a narrow profile that extends from the frame to the sash. Because of the compact size of the drive mechanism and its location adjacent to the frame and the sash, space is not allocated to increase the size of the frame at the expense of the size of the window. In one option, the screening panel presents an attractive interior for a window assembly by substantially concealing the input and output assemblies of the drive mechanism. Additionally, the mechanical linkage of the drive mechanism uses a small number of parts to effect opening and closing of the horizontally projecting window. The minimal number of parts reduces maintenance concerns and the costs associated therewith. Moreover, a single motion of the actuator arm moves the sash between the closed and open positions. The drive mechanism does not make use of drive shafts or cranks that are rotated multiple times to effect opening of the window. Further, the drive mechanism is adaptable for a wide variety of window sizes as multiple interchangeable input and output assemblies are installed in different sized windows when the length appropriate tie rod is used.

Further, the output assembly securely closes the window assembly and substantially prevents unwanted opening of the window assembly by pulling on the window sash. The hook of the elongate arm and notch on the cam slide, enhance the security of the window assembly by preventing rotation of the elongate arm with respect to the cam slide. Moreover, disposing the pin of the elongate arm within the sockets prevents unwanted movement of the sash between the open and closed positions.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
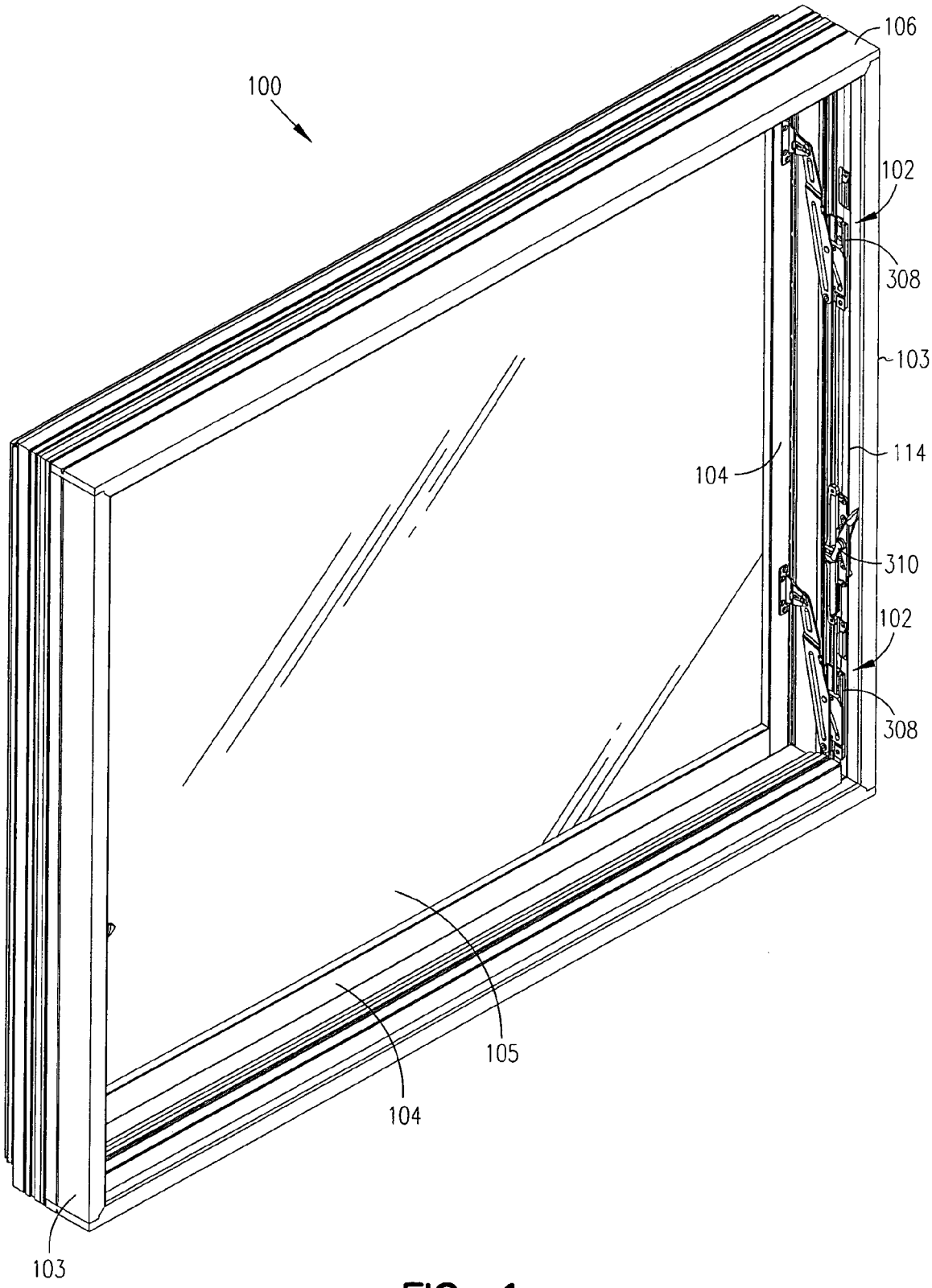
FIG. 1 is a perspective view illustrating a window assembly in an open position and constructed in accordance with one embodiment.

FIG. 1 is a perspective view of a window assembly 100 in an open position including at least one sash 104 and a frame 106. In one option, the sash 104 is dimensioned and configured to fit within the frame 106. In another option, the sash 104 is dimensioned and configured to project outwardly from the frame 106. The sash 104 is moved relative to the frame with a drive mechanism, such as drive mechanism 102. The drive mechanism 102, in one option, is operable for projecting the sash 104 substantially horizontally with respect to the frame 106. In another option, the sash 104 is substantially horizontal relative to the frame 106 in the open position, a closed position (FIG. 2) and intermediate positions therebetween. The sash 104 is substantially parallel to a plane defined by the frame 106 in the open position, closed position or intermediate positions, in yet another option. As shown in FIG. 1, the sash 104 is in the open position and projected away from the frame 106. The frame 106 includes wood, in one option. In another option, the frame 106 includes but is not limited to aluminum, steel and/or plastic. In yet another option, the frame 106 includes a composite construction (e.g., wood particles and a polymer). The sash 104 includes at least one glass pane 105, optionally.

Figure 2:
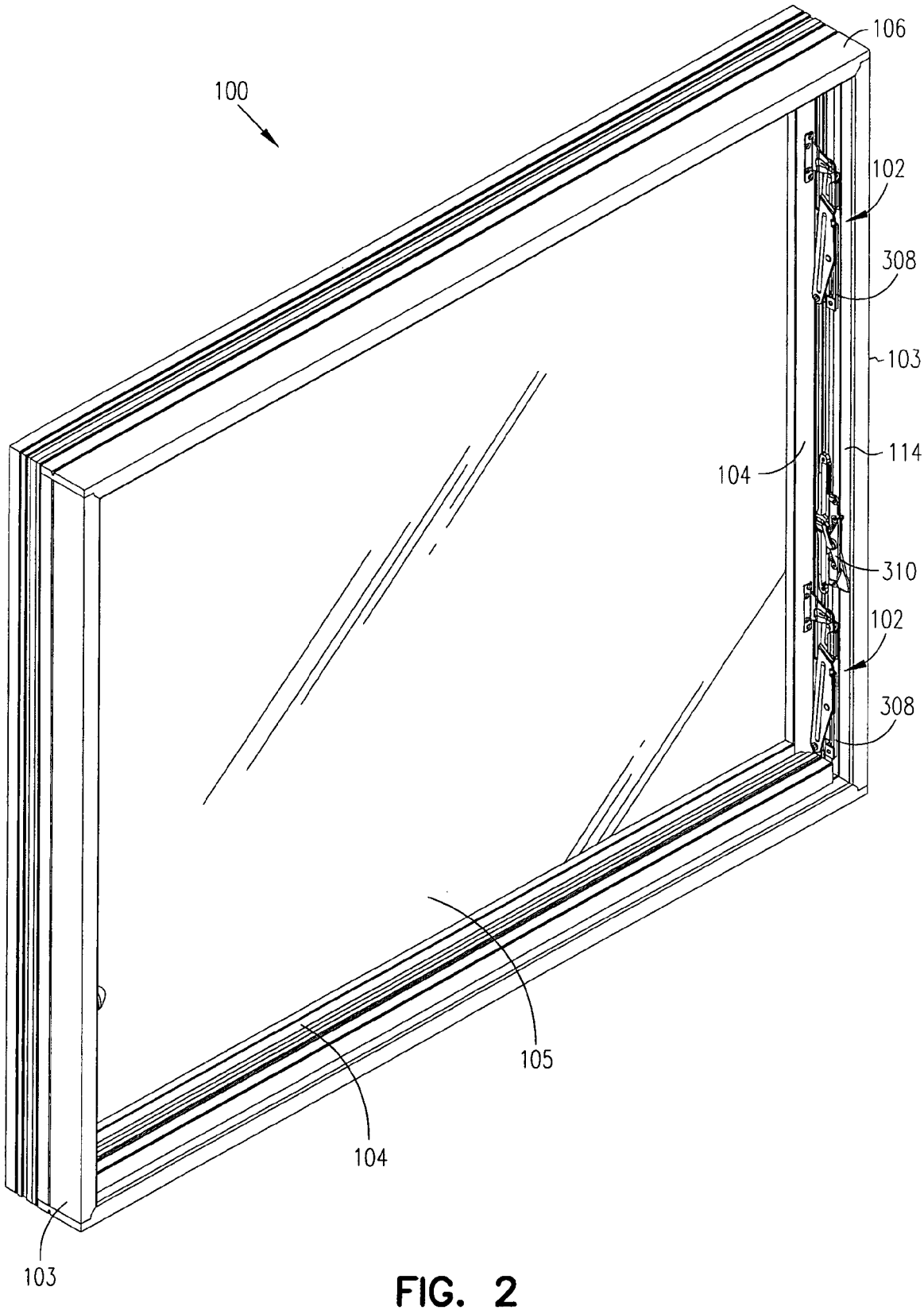
FIG. 2 is a perspective view illustrating a window assembly in a closed position and constructed in accordance with one embodiment.

FIG. 2 is a perspective view of the window assembly 100 in a closed position. The sash 104 is seated against the frame 106. In one option, the sash 104 tightly seals around the frame 106 and provides a substantially windproof and weatherproof barrier between the two sides of the window assembly 100. In another option, the sash 104 is disposed within the frame 106. The sash 104 is partially disposed within the frame 106, in yet another option.

In one option, the drive mechanism 102 (FIGS. 1 and 2) is coupled to the sash 104 and the frame 106. In another option, the drive mechanism 102 is coupled along the side member or jamb 103 of the window assembly 100. In a window assembly 100 including two opposed jambs 103, at least two drive mechanisms 102 are coupled along the jambs 103, in yet another option. Optionally, the drive mechanism 102 is coupled to an inner surface 114 of the frame 106. The drive mechanism 102 is not limited to being coupled to the inner surface 114. For instance the drive mechanism is disposed within the frame, in yet another option. The drive mechanism 102 moves the sash 104 between the open and closed positions (FIGS. 1 and 2). In one option, the drive mechanism 102 translates the sash 104 toward and away from the frame 106 and maintains the sash 104 substantially parallel to a plane defined by the frame 106.

Figure 3:
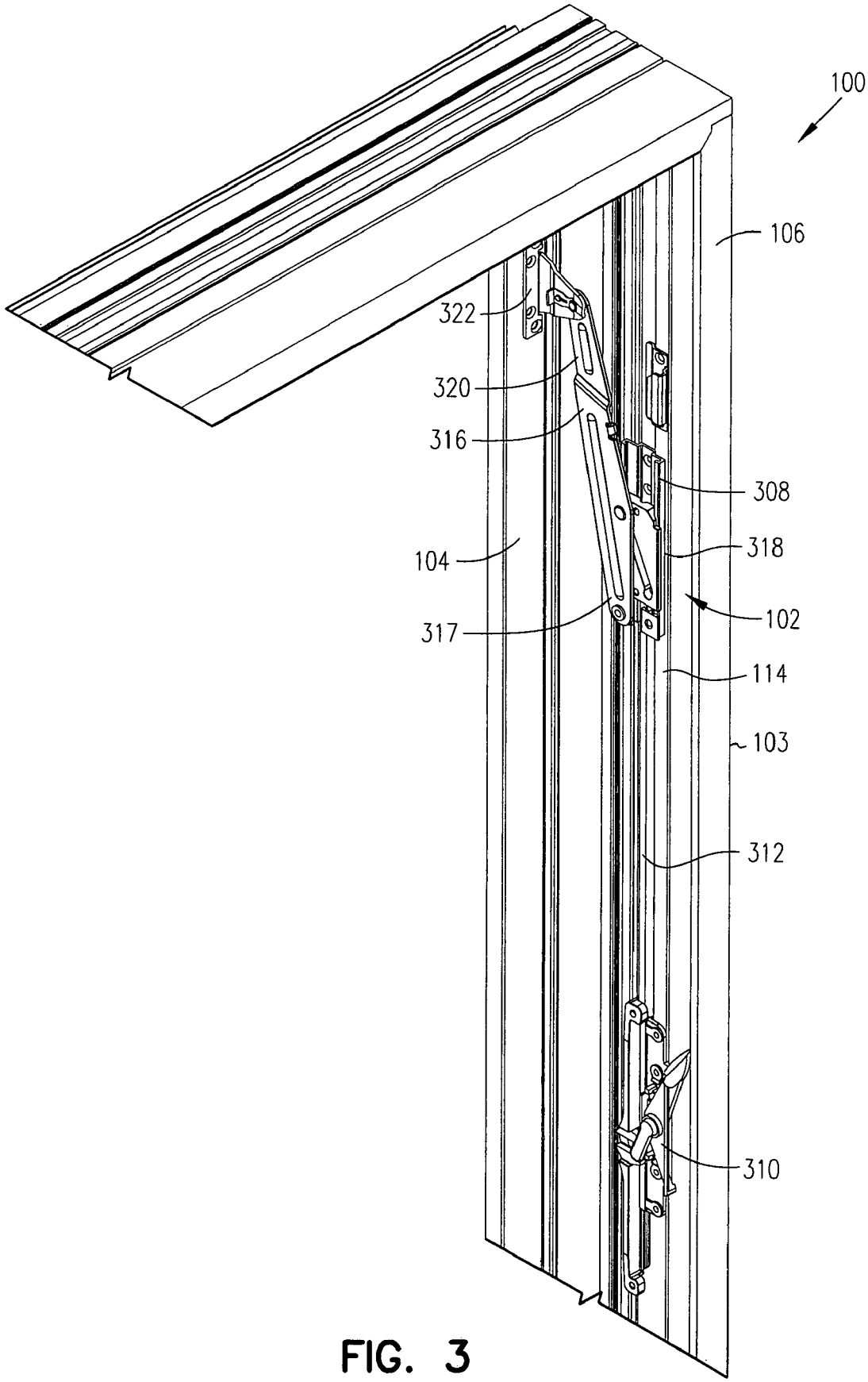
FIG. 3 is a detailed perspective view illustrating a window assembly in an open position and constructed in accordance with another embodiment.

FIG. 3 is a detailed perspective view of the drive mechanism 102. In one option, the drive mechanism 102 includes at least one output assembly 308 and an input assembly 310. The input assembly 310 is coupled to the output assembly 308 with, for instance, a tie bar 312. Optionally, the input assembly 310 is coupled to multiple output assemblies 308 with the tie bar 312. In one option, the output assemblies 308 are arranged above and below the input assembly 310 along the frame 106, as shown in FIGS. 1 and 2. In another option, the output assemblies 308 are arranged relatively above the input assembly 310 (See FIGS. 6, 7, 8 and 9). In yet another option, the output assemblies 308 are arranged below the input assembly 310.

In one option, the output assembly 308 includes an elongate arm 316 extending between the frame 106 and the sash 104. A first end 317 of the elongate arm 316 is rotatably coupled to a frame bracket 318, and the frame bracket 318 is coupled to the frame 106, in one option. Fasteners, such as screws, nails or the like couple the frame bracket 318 to the frame 106. A second end 320 of the arm 316 is coupled to the sash 104 with a sash bracket 322, in another option. The sash bracket 322 is coupled to the sash 104 with, screws, nails, adhesives or the like. In yet another option, the arm 316 is rotatably coupled to the frame bracket 318 and the sash bracket 322. The arm 316 is constructed with steel, in one option.

Figure 4:
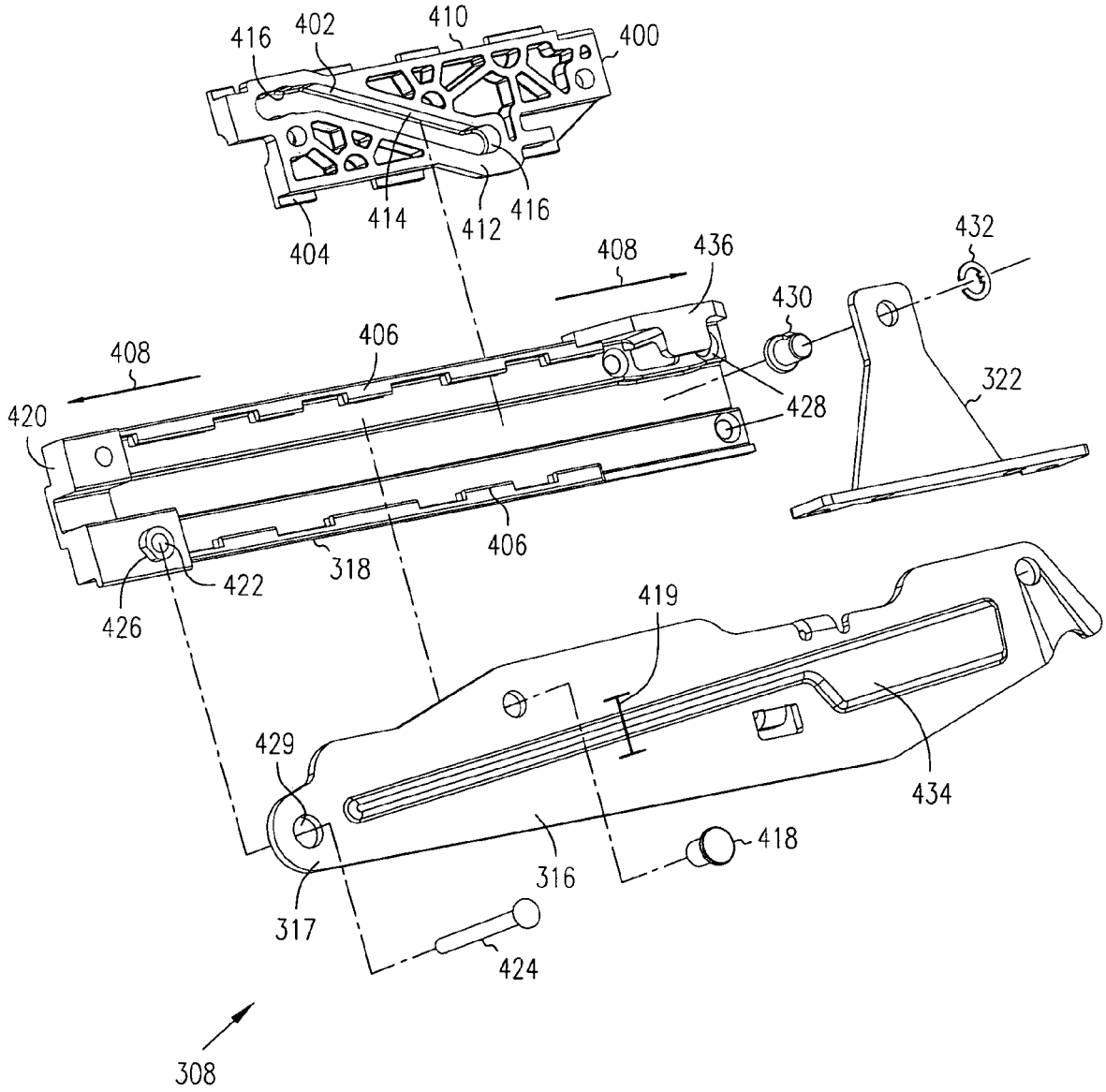
FIG. 4 is an exploded view illustrating an output assembly constructed in accordance with one embodiment.

FIG. 4 is an exploded view of the output assembly 308. A cam slide 400 including a slot 402 is dimensioned and configured to slidably couple with the frame bracket 318. The cam slide 400 includes grooves 404, in one option, along an outer perimeter of the cam slide 400. The frame bracket 318 includes guide rails 406 dimensioned and configured to fit within the grooves 404 and slidably couple the cam slide 400 to the frame bracket 318. The grooves 404 and guide rails 406 cooperatively permit translation of the cam slide 400 along the frame bracket 318 as shown with directional arrows 408. Optionally, the cam slide 400 includes, but is not limited to a polymer including polyoxymethylene sold under the name DELRIN® a registered trademark owned by E.I. Du Pont De Nemours and Company Corporation.

The slot 402 within the cam slide 400 includes an intermediate portion 414 and two end sockets 416. The intermediate portion 414 is slanted with respect to the direction of translation of the cam slide 400. In one option, the intermediate portion 414 of the slot 402 has a slope with respect to the direction of cam slide 400 translation. In another option, intermediate portion 414 of the slot 402 extends from a first side 410 of the cam slide 400 to a second side 412. In yet another option, the end sockets 416 extend from the intermediate portion 414. One of the end sockets 416 is substantially adjacent to the first side 410 of the cam slide 400 and the other end socket 416 is substantially adjacent to the second side 412. The end sockets 416, in yet another option, extend substantially parallel to the direction of translation of the cam slide 400.

In one option, the arm 316 is coupled to the cam slide 400 with a pin 418. The pin 418 is dimensioned and configured to fit within the slot 402. In another option, the pin 418 is slidably coupled to the cam slide 400 and moveable within the intermediate portion 414 and the sockets 416 of the slot 402. The pin 418, is moveable within the slot 402 between the first side 410 and the second side 412 of the cam slide 400. Optionally, the pin 418 is coupled to the arm 316 by press-fitting, welding, adhesives or the like. The pin 418 is integral with the arm 316, in another option. The pin 418, in yet another option, is moveably coupled to the cam slide 400 at a point offset from a line extending between where the elongate arm 316 is rotatably coupled to the sash 104 (FIG. 3) and where the elongate arm 316 is rotatably coupled to the frame bracket 318. The offset 419 of the pin 418 allows the elongate arm 316 to travel fully between the open and closed positions (described below) without contacting the sash 104. In still another option, the pin 418 and the slot 402 are reversed so the pin 418 extends from the cam slide 400 and the slot is in the elongate arm 316.

As described above, the arm 316 is rotatably coupled at the first end 317 to the frame bracket 318. In one option, a pivot seat 420 is coupled to an end of the frame bracket 318. The pivot seat 420 and the frame bracket 318 are integral, optionally. For instance, the pivot seat 420 and the frame bracket are cast from a single piece of metal, such as steel, aluminum or the like. In another option, the pivot seat 420 includes at least one lumen 422 dimensioned and configured to receive a fastener such as a pin 424, screw or the like. The pin 424 extends through the arm 316 to couple the arm 316 to the pivot seat 420. The lumen 422, in yet another option, is dimensioned and configured to receive a bushing 426 interposed between the pin 424 and an inner surface of the pivot seat 420 that defines the lumen 422. Optionally, the arm includes a corresponding opening 429 dimensioned and configured to receive the bushing 426 and the pin 424. In another option, where the pin 424 is a screw or the like, the frame bracket 318 includes a lumen dimensioned and configured to receive the pin 424 and the pin 424 extends into the frame 106 to secure the frame bracket 318 and pivot seat 420 to the frame 106 (FIG. 1). In yet another option, the pivot seat 420 is integral with the frame bracket 318. The frame bracket 318, in still another option, includes fastening lumens 428 dimensioned and configured to receive screws, nails or the like to further secure the frame output assembly 308 to the frame 106.

The output assembly 308 operates to move the sash 104 substantially horizontally with respect to the frame 106 (FIGS. 1, 2 and 3). The arm 316 is sized and shaped to support the sash 104 between the open and closed positions shown in FIGS. 1 and 2. The arm 316 optionally includes at least one rib 434 extending along at least a portion of the arm 316. The rib 434 strengthens the arm 316 without using additional material to form a thicker arm. In one option, the arm 316 is coupled to the sash bracket 322.

As described above, the sash bracket 322 is coupled to the sash 104 (FIG. 3). The arm 316 is coupled to the sash bracket 322, in one option, by a pin 430. The pin 430 extends through the arm 316 and the sash bracket 322. A clip 432 is coupled around at least a portion of the pin 430 and secures the pin 430 between the arm 316 and the sash bracket 322. In one option, the pin 430 is integral to the arm 316. In another option, the pin 430 is integral to the sash bracket 322.

Referring again to FIG. 4, in another option, the frame bracket 318 includes at least one projection 436. The projection 436 is sized and shaped to sandwich the arm 316 between itself and the frame bracket 318. The projection 436 and the frame bracket 318 cooperate to at least partially surround the arm 316 and substantially prevent twisting and lateral movement of the arm 316 (caused by, for instance, pushing and pulling on the sash 104). In the closed position (FIG. 2), the projection 436 and the frame bracket 318 ensure the sash 104 remains securely engaged to the frame 106 by surrounding the arm 316 and preventing twisting movement of the arm 316.

Figure 5:
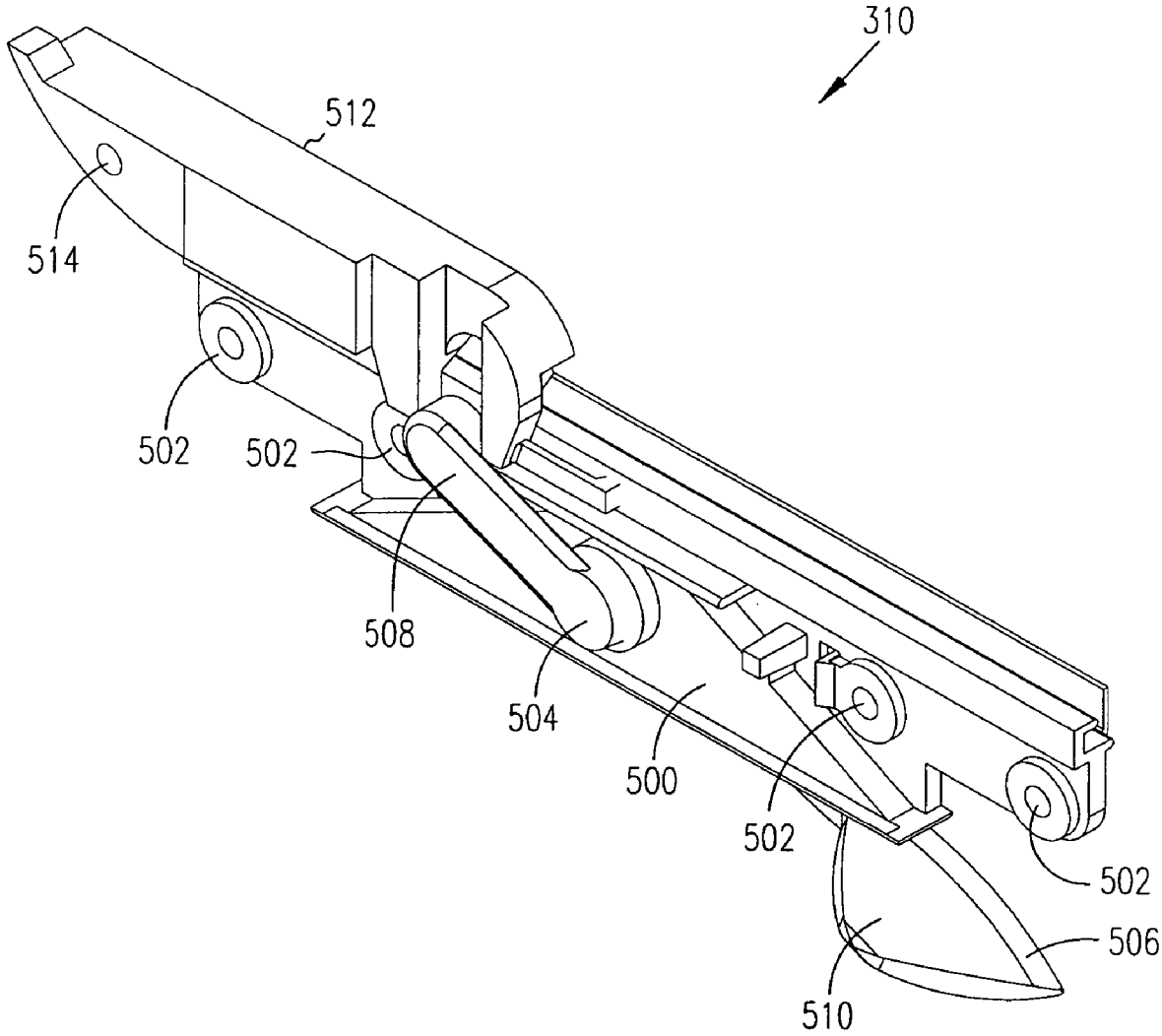
FIG. 5 is a perspective view illustrating an input assembly constructed in accordance with one embodiment.

FIG. 5 is a perspective view of the input assembly 310. The input assembly 310 includes, in one option, an actuator bracket 500. The actuator bracket 500 includes fastening lumens 502. Fasteners, including but not limited to screws, nails, rivets or the like are used to fasten the actuator bracket 500 to the frame 106 (FIG. 1). An actuator arm 504 is rotatably coupled to the actuator bracket 500 and extends through the bracket 500. Rotation of a first end 506 of the actuator arm 504 correspondingly rotates a second end 508 of the actuator arm 504. In one option, the first end 506 includes a grip 510 having increased surface area for easier operation of the actuator arm 504. The second end 508 of the actuator arm 504, in another option, is moveably coupled to an output linkage 512. The output linkage 512, optionally, is coupled at one end to the tie bar 312 (FIG. 4). The tie bar 312 is coupled to the output linkage through tie bar lumen 514. In another option, the second end 508 is directly coupled to the tie bar 312 and the output linkage 512 is omitted. The input assembly 310 includes, but is not limited to, steel, aluminum, cast zinc or the like. In yet another option, the actuator arm 504 is coupled to the tie bar 312 (FIG. 3) and the actuator arm 504 is rotatably coupled to the frame 106 (FIG. 1). Optionally, the actuator arm 504 translates with respect to the frame 106, as shown in FIGS. 1 and 3.

Figure 6:
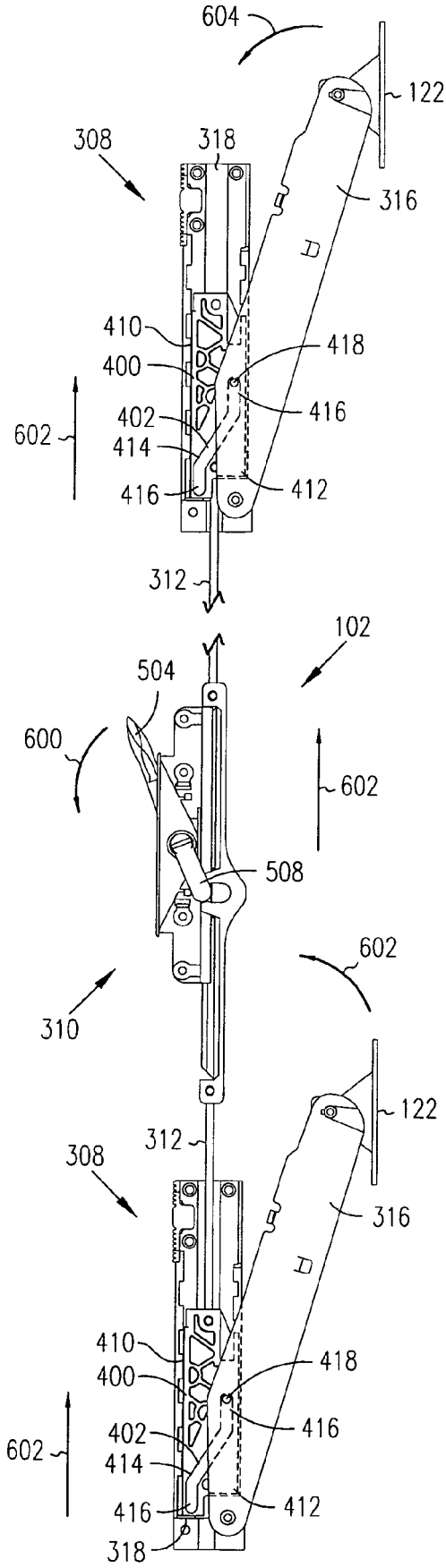
FIG. 6 is a side view illustrating a window drive mechanism in the open position constructed in accordance with one embodiment.

FIG. 6 is a side view of the drive mechanism 102 including an input assembly 310 coupled to two output assemblies 308. The input assembly 310 and output assemblies 308 are shown in an orientation where the sash 104 (FIG. 1) is in an open position. The output assemblies 308 are coupled to the input assembly 310, in one option, with the tie rod 312. In one option, the output assemblies 308 are selectively positionable along the tie rod 312. In another option, the output assemblies 308 are arranged above and below an input assembly 310 along the jamb 103 of the frame 106 (FIG. 1). Positioning the output assemblies 308 above and below the input assembly 310 secures the sash 104 to the frame 106 substantially adjacent to the corners of the frame, and strengthens the engagement of the sash 104 to the frame 106 in the closed position. The lengths of the tie rods 312 are determined according to the particular dimensions of the sash 104 and the frame 106 (FIG. 1). In one option, tie rods 312 having a variety of lengths are used interchangeably to position the input assembly 310 and output assemblies 308 within window assemblies of varying sizes. The input assembly 310 and output assemblies 308, with the corresponding tie rods 312, are interchangeable between different sizes of windows. In another option, the drive mechanism 102, in another option includes two tie rods 312. A first tie rod 312 extends from the input assembly 310 to the first output assembly 308. A second tie rod 312 extends between the first output assembly 308 and the second output assembly 308.

Figure 7:
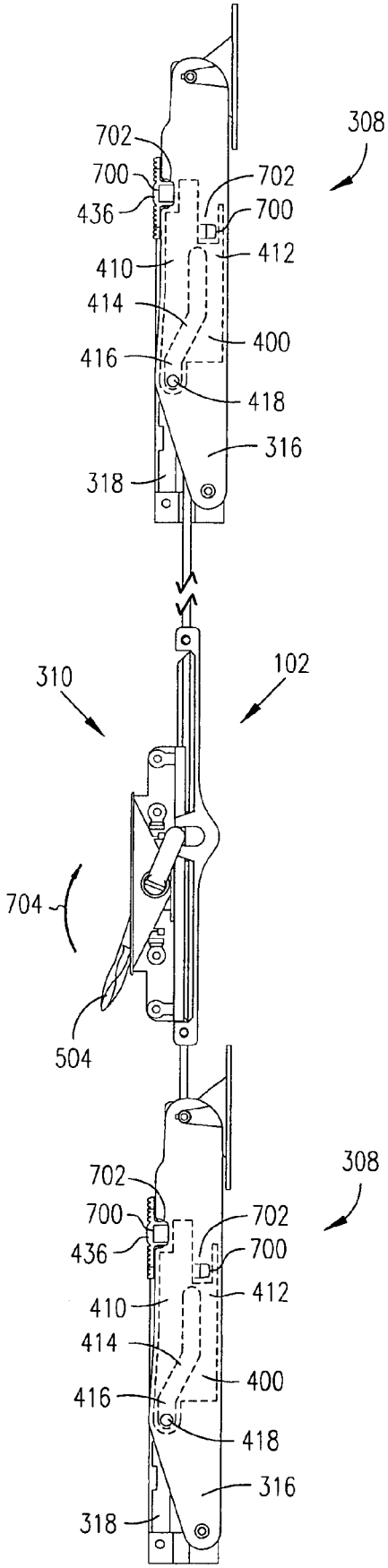
FIG. 7 is a side view illustrating a window drive mechanism in the closed position and constructed in accordance with one embodiment.

FIG. 7 is another side view of the drive mechanism 102 including an input assembly 310 coupled to two output assemblies 308. The input assembly 310 and output assemblies 308 are shown in an orientation where the sash 104 (FIG. 2), is in a closed position, as described below. The pin 418 is disposed within the socket 416 and is substantially adjacent to the first side 410 of the cam slide 400. In one option, as the pin 418 enters the socket 416 along the first side 410 the arm 316 ceases to rotate because the pin 418 exits the intermediate portion 414 that is slanted with respect to the direction of travel of the cam slide 400. The actuator arm 504 continues to move, in another option, in the direction of arrow 600 (See FIG. 6). The cam slide 400 moves in the direction of arrow 602 (FIG. 6) with rotation of the actuator arm 504. Movement of the cam slide 400 in this direction, in yet another option, seats the pin 418 within the socket 416. The socket 416 extends substantially parallel to the direction of movement of the cam slide 400 and prevents unwanted rotation of the arm 316. In one option, the socket 416 substantially prevents rattling or slamming of the sash 104 (FIG. 2) between the open and closed position caused by pressing or pulling on the sash 104 or the like. In another option, disposing the pin 418 within the socket 416 substantially adjacent to the first side 410 secures the sash 104 against the frame 106 and helps prevent unwanted opening of the window assembly 100 by pulling on the sash 104, as shown in FIG. 2. The slot 416 along the first side 410 is longer, optionally, than the slot 416 on the second side 412 to ensure secure seating of the pin 416 when the sash 104 is in the closed position.

In another option, at least one of the output assemblies 308 include a hook 700 and a notch 702 to increase the security of the window assembly. Optionally, both of the output assemblies 308 include hooks 700 and notches 702. As shown in FIG. 7, the output assemblies 308 include dual hooks 700 and corresponding dual notches 702. The hooks 700 extend from the arm 316, in one option, in a direction orthogonal to the arm 316. The hooks 700 are constructed with, for instance, the same-materials used in the arm 316 (e.g. steel). The hooks 700 extend from the arm 316 a sufficient length to engage the notches 702 in the cam slide 400 when the notches 702 are disposed substantially adjacent to the hooks 700. After the pin 418 enters the socket 416, the cam slide 400 continues to travel with movement of the actuator arm 504. The arm 316 of the output assembly 308 has stopped rotating because the pin 418 is within the socket 416 that is substantially parallel to the direction of cam slide 400 travel. The cam slide 400 including the notches 702 moves toward the stationary hooks 700, and the hooks 700 are seated against the notches 702. Seating of the hooks 700 within the notches 702 substantially prevents opening of the sash 104 (FIG. 1) by pulling on the sash 104. In one option, the engagement of the hooks 700 with the notches 702 locks the sash 104 in the closed position and substantially prevents unwanted rotation of the arm 316 to open the window assembly 100 by pulling on the sash 104. The arm 316 can only be rotated and the window assembly 100 opened by operation of the actuator arm 504 in the direction shown with arrow 704. Moving the actuator arm 504 moves the cam slide 400 and the notches 702 out of engagement with the hooks 700 and allows rotation of the arm 316.

Figure 8:
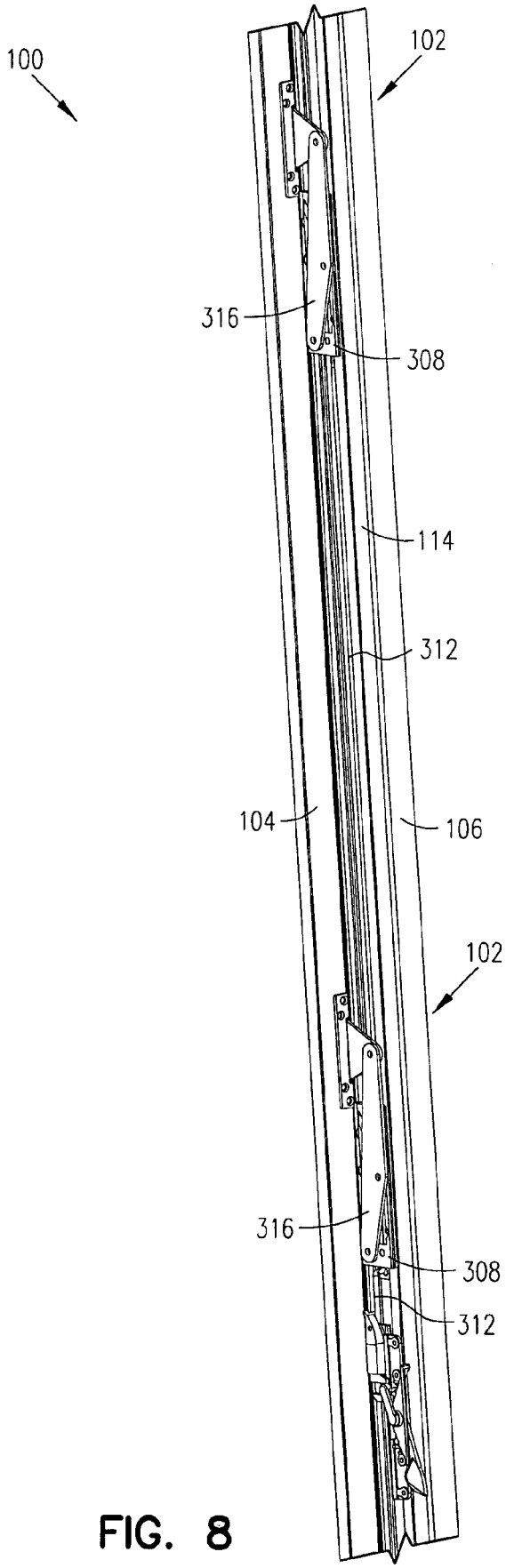
FIG. 8 is a perspective view illustrating a window assembly in a closed position.

FIG. 8 is a perspective view of the window assembly 100 including the drive mechanism 102 in the closed position. The arms 316 are fully retracted toward an inner surface 114 of the frame 106. In another option, the elongate arms 316 assume a substantially vertical orientation parallel to the adjacent portion of the frame 106. The hooks 700 are disposed within the respective notches 702 (FIG. 7) to lock the sash 104 against the frame 106, in one option. In another option, the hooks 700 and the notches 702 cooperate with the sockets 416 (FIG. 7) to secure the sash 104 against the frame 106. Rotation of the arms 316 by pulling on the sash 104 does not open the window assembly 100 because the hooks 700 are disposed within the notches 702 and the pins 418 are disposed within the sockets 416 (FIG. 7) to lock the sash 104 against the frame 106. The sash 104 and frame 106 optionally include locks, latches or the like to secure the sash 104 against the frame 106 in the closed position.

Referring again to FIG. 7, the projection 436 and the frame bracket 318 cooperate to substantially prevent twisting motion of the arms 316 caused, for example, by high winds. The projection 436 and the frame bracket 318 at least partially surround the arm 316 in the closed position. Pulling on the sash 104 (FIG. 1) away from the frame 106 or laterally (i.e., side to side) does not twist the arms 316 to loosen the engagement of the sash 104 to the frame 106 because of the additional support provided to the arms 316 by the projection 436 and the frame bracket 318. Additionally, the projection 436 cooperates with the bracket 318 to substantially prevent twisting of the arms 316 and dislodging of the hooks 700 from the notches 702.

Figure 9:
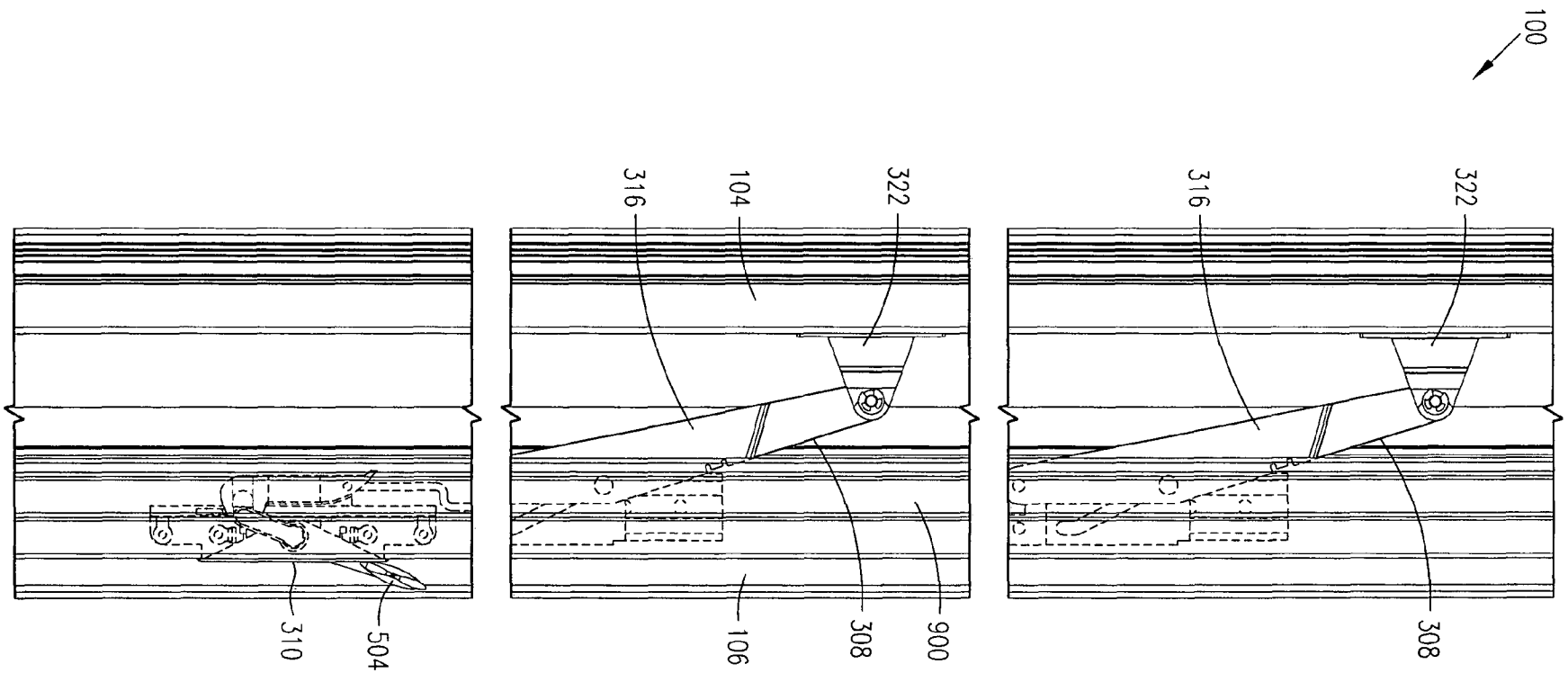
FIG. 9 is a side view of a window assembly in the open position with a screening panel constructed in accordance with another embodiment.

FIG. 9 is a side view of a portion of the frame 106 and the sash 104. In one option, the input assembly 310 and the output assemblies 308 are at least partially hidden by a screening panel 900. In another option, the screening panel 900 includes a vinyl substrate with a wooden veneer chosen to match the wood grain of the window assembly 100. The screening panel 900, in yet another option, is a thin wooden shell. The screening panel 900 is coupled to the frame 106 with, for instance, adhesives, fasteners, a vinyl barb retained within a kerf or the like. The screening panel 900 provides an attractive cover to substantially isolate the input assembly 310 and output assemblies 308 from view. The input assembly 310 and the output assemblies 308 are sufficiently slender so the screening panel 900 appears to be an ordinary part of the frame 106. The arms 316 and sash brackets 322 are exposed, in one option, to facilitate coupling of the arms 316 to the sash 104. The actuator arm 504 is exposed, in another option, to permit operation of the input assembly 310 and the output assemblies 308. In yet another option, the arms 316 and the actuator arm 504 extend through the screen panel 900.

Referring again to FIG. 6, in operation, rotation of the actuator arm 504 in the direction shown by arrow 600, correspondingly moves the tie rod 312 according to the rotation of the second end 508 of the arm 504. The tie rod 312 moves in a direction shown by arrow 602. In one option, rotation of the actuator arm 504 is translated into linear movement of the tie rod 312 that is rotatably coupled to the second end 508 of the arm 504. Advancing the tie rod 312 correspondingly advances the cam slide 400 that is slidably engaged, in another option, to the frame bracket 318. The cam slide 400 moves in the direction of arrow 602, in yet another option, because the cam slide 400 is constrained by the guide rails 406 (FIG. 4) to move along the length of the frame bracket 318.

Optionally, with multiple output assemblies 308 as shown in FIG. 6, movement of the actuator arm 504 is transmitted to each of the output assemblies 308 by the tie rods 312. In one option, movement of the actuator arm 504 is transmitted to a plurality of output assemblies 308, for instance, output assemblies 308 arranged above and below the input assembly 310 (FIGS. 1, 2, 6 and 7). The actuator arm 504 movement is distributed by the tie rods 312 to the cam slides 400. In another option, shown in FIG. 8, movement of the tie rod 312 proximal to the input assembly 310 is transmitted to the cam slide 400 (FIG. 4) of a proximal output assembly 308. The movement of the cam slide 400 of the proximal output assembly 308 is transmitted to the distal tie rod 312 extending between the output assemblies 308, which in turn moves the cam slide 400 (FIG. 4) of the output assembly 308 distal to the input assembly 310. The output assemblies 308 and the input assembly 310 operate in a substantially similar manner in any arrangement along the frame 106.

In another option, the pin 418 coupled to the arm 316 of the output assembly 308 proximal to the input assembly 310, is disposed within the slot 402. As shown in FIG. 6, the pin 418 is disposed within a socket 416 of the cam slide 400. In one option, the initial movement of the cam slide 400 in the direction of the arrow 602 does not rotate the arm 316. The pin 418 is in the socket 416 and the socket 416 extends in a direction substantially parallel to the movement of the cam slide 400. Having the socket 416 extend substantially parallel to the direction of movement of the cam slide 400 prevents unwanted rotation of the arm 316 caused, for instance, by wind moving across the sash 104 (FIGS. 1 and 3). In another option, the socket 416 substantially prevents rattling or slamming of the sash 104 between the open and closed position caused by pressing and/or pulling on the sash 104 or the like.

Additional movement of the cam slide 400, in one option, caused by the actuator arm 504 and the tie rod 312, moves the pin 418 into the intermediate portion 414 of the slot 402 that is slanted relative to the direction of travel of the cam slide 400. The cam slide 400 engages the pin 418 and moves the pin 418 from the second side 412 to the first side 410 of the cam slide 400. Movement of the pin 418 caused by translation of the cam slide 400 rotates the arm 316. In one option, the arm 316 rotates around the coupling to the pivot seat 420. The pin 418 moves from the second side 412 to the first side 410 during translation of the cam slide 400 and the arm 316 follows this motion and rotates correspondingly as shown with directional arrow 604. The arm 316 follows the movement of the pin 418 within the intermediate portion 414 until the pin 418 is disposed within the socket 416 substantially adjacent to the first side 410 of the cam slide 400. The arm 316 has rotated the sash 104 into engagement with the frame 106 and the sash 104 is in a closed position (See FIG. 8).

The operation described above may be reversed to project the sash 104 from the frame 106 into the open position. In the open position shown in FIGS. 1 and 3, the sash 104 is spaced from the frame 106 and is substantially parallel to the frame 106. The sash 104, in another option, when transitioning between the closed position and open position, is substantially parallel to the frame 106. Ventilation is facilitated with this arrangement as air moves between the sash 104 and the frame 106 around all of the edges of the sash 104. Ventilation occurs around the edges of the sash 104 in the open position and when transitioning between the closed and open positions. In one option, a screen assembly extends between the sash 104 and the frame 106 to allow for ventilation and prevent the ingress of insects and the like. One example of a screen assembly useable with the window assembly 100 is described in U.S. patent application Ser. No. 10/933,686, filed on Sep. 3, 2004, entitled, "SCREEN ASSEMBLY FOR OUTWARDLY PROJECTING WINDOW," which is assigned to the assignee of the present application and which is incorporated by reference herein in its entirety.

Figure 10:
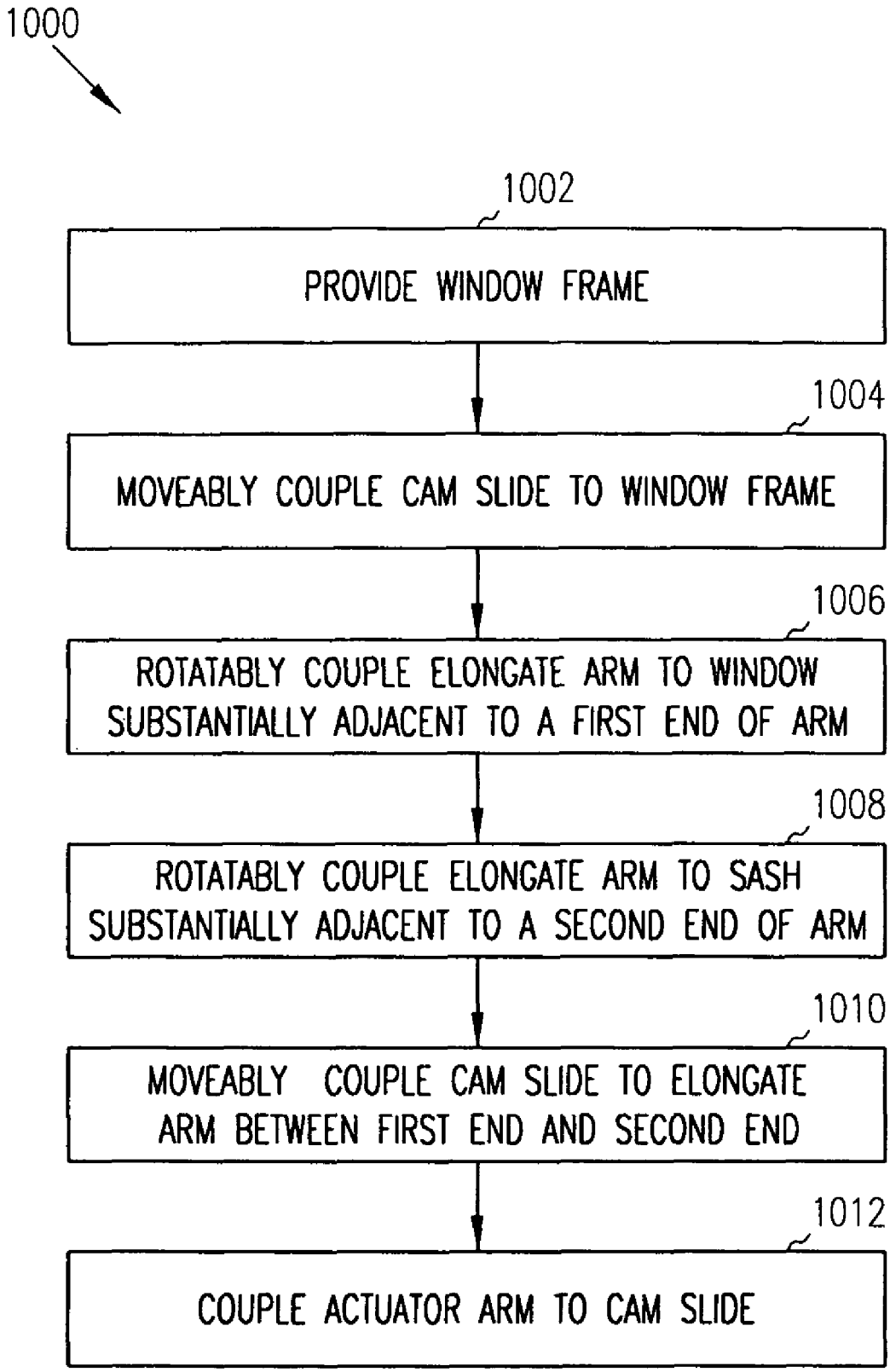
FIG. 10 is a block diagram showing one method of making a window assembly.

FIG. 10 is a block diagram showing a method 1000 for making a window assembly. At 1002, a window frame is provided. At 1004, a cam slide is moveably coupled to the window frame. In one option, the cam slide is coupled to the window frame with a bracket and the cam slide is slidably coupled to the bracket. In another option, the cam slide is coupled to guide rails extending from the bracket. The guide rails, in yet another option, allow sliding movement of the cam slide along the bracket. At 1006, an elongate arm is rotatably coupled to the window frame. In one option, the elongate arm is coupled to the window frame substantially adjacent to a first end of the arm. The elongate arm is rotatably coupled to a frame bracket, in another option, and the frame bracket couples the elongate arm to the frame. At 1008, the elongate arm is rotatably coupled to a sash. The sash is disposed within the window frame, in one option. In another option, the elongate arm is coupled to the sash substantially adjacent to a second end of the arm. The elongate arm is rotatably coupled to the sash, optionally, with a sash bracket coupled to the sash. At 1010, the cam slide is moveably coupled to the elongate arm. The cam slide is coupled to the elongate arm between the first and second ends, in one option. Optionally, the elongate arm includes a pin, and the pin is disposed within a slot in the cam slide that is slanted relative to a movement direction of the cam slide. In another option, the slot extends along a slope relative to the movement direction of the cam slide. The pin, in one option, moveably couples the elongate arm to the cam slide. At 1012, an actuator arm is coupled to the cam slide. In one option, a tie rod extends between the actuator arm and the cam slide and couples the cam slide to the actuator arm. In another option, the actuator arm is rotatably coupled to the cam slide.

The method 1000 includes, in another option, covering the cam slide, a portion of the elongate arm and a portion of the actuator arm with a screening panel. In one option, the second end of the elongate arm coupled to the sash extends out of the screening panel. In another option, one end of the actuator arm extends out of the screening panel and is visible. In yet another option, the screening panel is coupled to the window frame.

The window drive mechanism described herein provides a compact system disposed between the sash and the window frame. In one option, the drive mechanism is coupled to the jambs of the window frame and presents a narrow profile that extends from the frame to the sash. Because of the compact size of the drive mechanism and its location adjacent to the frame and the sash, space is not allocated to increase the size of the frame at the expense of the size of the window. In one option, the screening panel substantially conceals the input and output assemblies and presents an attractive interior for a window assembly.

Additionally, the mechanical linkage of the drive mechanism uses a small number of parts to effect opening and closing of the horizontally projecting window. The minimal number of parts used reduces maintenance concerns and the costs associated therewith. Moreover, a single motion of the actuator arm moves the sash between the closed and open positions. The drive mechanism described herein does not make use of drive shafts or cranks that are rotated multiple times to effect opening of the window. Further, the drive mechanism is adaptable for a wide variety of window sizes as multiple interchangeable input and output assemblies are installed in different sized windows in various arrangements when the appropriate tie rod is used.

Further, the output assembly securely closes the window assembly and substantially prevents unwanted opening of the window assembly by pulling on the window sash. Disposing the pin extending from the elongate arm within one of the sockets helps prevent unwanted opening of the window assembly by pulling on the sash. The hook of the elongate arm and notch on the cam slide, enhance the security of the window assembly by preventing rotation of the elongate arm with respect to the cam slide. Moreover, disposing the pin of the elongate arm within the sockets substantially prevents unwanted movement of the sash (e.g., caused by pushing and pulling on the sash) between the open and closed positions.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A window drive mechanism comprising:

a bracket having a bracket longitudinal axis;

a cam slide slidably coupled along the bracket, the bracket constraining the cam slide to move the entire cam slide between a first longitudinal position and a second longitudinal position along the bracket longitudinal axis;

an elongate arm having a first end and a second end, the first end of the elongate arm rotatably coupled with the bracket, the elongate arm includes a follower movably coupled with the cam slide between the first and second ends, the elongate arm is movable between a first closed position and a second open position, in the first closed position the second end of the elongate arm is retained along the bracket and the first end of the elongate arm is remote from the cam slide, in the second open position the second end of the elongate arm is remote from the bracket and the first end of the elongate arm is adjacent to the cam slide; and an actuator arm coupled to the cam slide, the actuator arm moves the cam slide along the bracket.

2. The window drive mechanism of claim 1, wherein the cam slide includes a slot, and at least a portion of the slot is slanted relative to a movement direction of the cam slide.

3. The window drive mechanism of claim 2, wherein the cam slide includes at least one socket, and the socket is in communication with at least the portion of the slot, and the socket extends substantially parallel to the movement direction of the cam slide.

4. The window drive mechanism of claim 3, wherein the follower includes a pin slidably positioned within the slot and the at least one socket, and when the pin is positioned within the at least one socket the elongate arm is not rotatable.

5. The window drive mechanism of claim 2, wherein the follower includes a follower pin extending from the elongate arm between the first end and the second end, and the follower pin is disposed in the slot.

6. The window drive mechanism of claim 1, wherein the elongate arm is rotatably coupled at the second end to a sash with a sash bracket.

7. The window drive mechanism of claim 6, wherein the elongate arm is moveably coupled to the cam slide at a point offset from a line extending between where the elongate arm is rotatably coupled to the sash and where the elongate arm is rotatably coupled to the bracket.

8. The window drive mechanism of claim 1, wherein the actuator arm is rotatably coupled to an actuator bracket.

9. The window drive mechanism of claim 1, wherein the actuator arm is coupled to the cam slide by a tie rod, and movement of the tie rod along the bracket longitudinal axis correspondingly moves the cam slide along the bracket longitudinal axis.

10. The window drive mechanism of claim 9, wherein the actuator arm is rotatably coupled to the tie rod.

11. The window drive mechanism of claim 1, wherein the bracket includes at least one projection extending away from the bracket, and the bracket and the at least one projection at least partially surround the elongate arm, and the bracket and the at least one projection support an interior elongate arm side and an exterior elongate arm side when the elongate arm is in a closed orientation.

12. The window drive mechanism of claim 1, wherein the cam slide includes at least one notch dimensioned and configured to receive at least one hook extending from the elongate arm, the at least one hook is received in the notch when the elongate arm is in a closed orientation, and rotation of the elongate arm is substantially prevented by the hook received in the notch.

13. The window drive mechanism of claim 1, wherein the first end is rotatably coupled at a fixed position along the bracket.

14. A window assembly comprising:

a window frame;

a sash moveably coupled to the window frame;

a cam slide moveably coupled with the window frame along a window frame longitudinal axis, the entire cam slide is movable between a first window frame longitudinal position and a second window frame longitudinal position; and an elongate arm rotatably coupled between the window frame and the sash, a first end of the elongate arm is rotatably coupled with the window frame at a fixed window frame position along the window frame, a second end of the elongate arm is rotatably coupled with the sash at a fixed sash position along the sash, and a follower is movably coupled with the cam slide between the first and second ends of the elongate arm; and movement of the cam slide between the first window frame longitudinal position and the second window frame longitudinal position moves the sash from a sash closed position to a sash open position, and the sash is parallel to the window frame from the sash open position to the sash closed position.

15. The window assembly of claim 14, wherein the cam slide is moveably coupled to a frame bracket and the frame bracket is coupled to the window frame.

16. The window assembly of claim 15, wherein the frame bracket includes at least one guide rail extending around at least a portion of the cam slide, and the cam slide is slidably coupled along the at least one guide rail.

17. The window assembly of claim 16, wherein the cam slide is slidably coupled to the frame bracket and retained substantially adjacent to the frame bracket by the at least one guide rail.

18. The window assembly of claim 15, wherein the elongate arm is rotatably coupled to the frame bracket.

19. The window assembly of claim 14, wherein the cam slide includes a slot having a slope relative to a movement direction of the cam slide.

20. The window assembly of claim 19, wherein the follower includes a follower pin extending from the elongate arm between the first end and the second end, and the follower pin is disposed in the slot.

21. The window assembly of claim 20, wherein the slot includes at least one socket extending in a direction parallel with the window frame longitudinal axis, and when the follower pin is positioned within the at least one socket the elongate arm is not rotatable.

22. The window assembly of claim 14, further comprising an actuator arm coupled to the cam slide.

23. The window assembly of claim 22, wherein the actuator arm is coupled to a tie rod and the tie rod is coupled to the cam slide.

24. The window assembly of claim 23, wherein the cam slide is selectively positionable along the tie rod.

25. The window assembly of claim 22, wherein the actuator arm is rotatably coupled to an actuator bracket and the actuator bracket is coupled to the frame.

26. The window assembly of claim 22, further comprising a screening panel coupled to the window frame and covering at least a portion of the actuator arm.

27. The window assembly of claim 14, further comprising a screening panel coupled to the window frame and covering the cam slide and at least a portion of the elongate arm.

28. The window assembly of claim 14, wherein the sash is substantially parallel to the window frame in the sash open position, sash closed position, and a sash intermediate position between the sash open position and sash closed position.

29. The window assembly of claim 14, wherein the cam slide includes at least one notch dimensioned and configured to receive at least one hook extending from the elongate arm, the at least one hook received in the notch when the sash is in the closed position, and rotation of the elongate arm is substantially prevented by the hook received in the notch.

30. The window assembly of claim 14, wherein the cam slide is slidably coupled along a cam slide track extending along the window frame parallel to the window frame longitudinal axis, and the cam slide is slidable along the cam slide track between the first window frame longitudinal position and the second window frame longitudinal position.

* * * * *